US007652229B2

(12) United States Patent
Alves et al.

(10) Patent No.: US 7,652,229 B2
(45) Date of Patent: Jan. 26, 2010

(54) ELECTRICAL HEATING ARRANGEMENT

(75) Inventors: Brian Roger Alves, Malvern (GB); Stuart Lamb, Redditch (GB)

(73) Assignee: Stylewell Limited, Cardiff (GB)

( * ) Notice: Subject to any disclaimer, the term of this patent is extended or adjusted under 35 U.S.C. 154(b) by 462 days.

(21) Appl. No.: 10/587,411

(22) PCT Filed: Feb. 2, 2005

(86) PCT No.: PCT/GB2005/000368

§ 371 (c)(1),
(2), (4) Date: Apr. 12, 2007

(87) PCT Pub. No.: WO2005/076667

PCT Pub. Date: Aug. 18, 2005

(65) Prior Publication Data

US 2007/0228031 A1 Oct. 4, 2007

(30) Foreign Application Priority Data

Feb. 4, 2004 (GB) ..... 0402412.1

(51) Int. Cl.
*H05B 3/68* (2006.01)

(52) U.S. Cl. ..... 219/448.11; 219/460.1

(58) Field of Classification Search .... 219/443.1–468.2
See application file for complete search history.

(56) References Cited

U.S. PATENT DOCUMENTS 6,940,048 B2 * 9/2005 Wilkins ..... 219/448.13
6,995,344 B2 * 2/2006 McWilliams ..... 219/448.17
7,030,342 B2 * 4/2006 McWilliams ..... 219/460.1
2003/0178405 A1 * 9/2003 McWilliams ..... 219/448.14

FOREIGN PATENT DOCUMENTS

| | | |
|---|---|---|
| EP | 0806886 | 11/1997 |
| EP | 0806887 | 11/1997 |
| WO | 03007660 | 1/2003 |
| WO | 2004111589 | 12/2004 |

* cited by examiner

*Primary Examiner*—Sang Y Paik
(74) *Attorney, Agent, or Firm*—Ira S. Dorman

(57) ABSTRACT

A temperature sensor assembly (30) is provided for an electrical heating arrangement (2). The temperature sensor assembly (30) includes a substrate (32) located in a heater (12). The substrate (32) has an upper surface (38) in contact with the lower surface (10) of a cooking plate (4). The upper and/or lower surface or surfaces (38, 66) of the substrate (32) is provided with a first temperature-sensitive resistance element (40) at a first region (42) of the substrate (32) proximate a peripheral region (34) of the heater. The upper (38) and/or lower (66) surface or surfaces of the substrate (32) is or are provided with a second temperature-sensitive resistance element (54; 54A; 54B) at a second region (56) of the substrate (32) proximate the central region (36) of the heater. A support member (70; 102) is secured to the substrate (32) and underlies at least the first region (42) of the substrate (32) and thermal insulation means (74) is interposed between the lower surface (66) of the substrate (32) and the support member (70) only at the first region (42) of the substrate (32).

25 Claims, 5 Drawing Sheets

ELECTRICAL HEATING ARRANGEMENT

This invention relates to an electrical heating arrangement in a cooking appliance comprising a cooking plate, such as of glass-ceramic material, which has an upper surface for receiving a cooking utensil and a lower surface; an electric heater incorporating at least one electric heating element, the heater being in contact with the lower surface of the cooking plate, and a temperature sensor assembly.

It is known to provide an electrical heating arrangement for a cooking appliance in which a temperature sensing device is arranged under a glass-ceramic cooking plate in order to monitor the temperature of a cavity between a heating element of an electric heater and an underside of the glass-ceramic plate, whereby to monitor the temperature of the glass-ceramic plate and to operate to control energising of the heating element, particularly to ensure that the temperature of the glass-ceramic plate does not exceed a safe limit value. Such a temperature sensing device is known to comprise a temperature-sensitive electrical resistance element supported on a suitable substrate and arranged to be subjected to direct thermal radiation from the heating element.

A different requirement relates to the sensing of temperature of a cooking utensil located on the upper surface of a cooking plate, using a temperature sensing device provided underneath the cooking plate. Here it is required to be able to measure small changes in temperature in the cooking plate overlying the temperature sensing device and good thermal coupling is required between the temperature sensing device and the cooking plate. However, if the temperature sensing device also receives direct thermal radiation from the heating element in the underlying heater, this makes it difficult to distinguish small changes in temperature of the cooking plate associated with the overlying cooking utensil.

It is known to provide what is referred to as a "cool patch" of a glass-ceramic cooking plate within a heated area by an arrangement in which a discrete temperature sensing device surrounded by a thermally insulating enclosure is urged directly against a region of the lower surface of the cooking plate, to sense a change in temperature of the cooking plate produced by an overlying cooking utensil conducting heat back into the cooking plate in that area. Such a discrete temperature sensing device has been provided of capillary or electromechanical form, or of platinum resistance temperature detector form, urged against the lower surface of the cooking plate, such as by spring loading means.

The provision of two separately formed temperature sensing devices in an electrical heating arrangement to fulfil the two requirements of monitoring cooking utensil temperature and cooking plate temperature is cumbersome and expensive and it is an object of the present invention to overcome or minimise this problem.

According to the present invention there is provided an electrical heating arrangement comprising: a cooking plate having an upper surface for receiving a cooking utensil, and a lower surface; an electric heater incorporating at least one electric heating element, the heater being supported in contact with the lower surface of the cooking plate; and a temperature sensor assembly, wherein the temperature sensor assembly comprises: an elongate substantially planar substrate located in the heater and extending at least partially across the heater from a peripheral region at least to a central region of the heater, the substrate having an upper surface located in contact with, or in close proximity to, the lower surface of the cooking plate, and also having a lower surface, the upper and/or lower surface or surfaces of the substrate being provided with at least one first temperature-sensitive electrical resistance element of film form at a first region of the substrate arranged to be proximate the peripheral region of the heater, the upper and/or lower surface or surfaces of the substrate being provided with at least one second temperature-sensitive electrical resistance element of film form at a second region of the substrate proximate the central region of the heater, the first and second temperature-sensitive electrical resistance elements being provided with electrical connecting leads for electrical connection to external control circuit means for the heater; at least one support member secured to the substrate and underlying at least the first region of the substrate; and thermal insulation means interposed between at least the lower surface of the substrate and the at least one support member substantially only at the first region of the substrate.

The thermal insulation means may shield the at least one first temperature-sensitive electrical resistance element and a region of the cooking plate overlying the at least one first temperature-sensitive electrical resistance element, from direct thermal radiation from the at least one electric heating element.

The at least one first temperature-sensitive electrical resistance element may be arranged for monitoring temperature of the cooking utensil through the cooking plate.

The at least one second temperature-sensitive electrical resistance element may be arranged for monitoring temperature of the lower surface of the cooking plate.

At least two second temperature-sensitive electrical resistance elements may be provided on the upper and/or lower surfaces of the substrate.

The upper surface of the substrate may be arranged at a distance of 0 mm to about 3.5 mm from the lower surface of the cooking plate.

The at least one support member may be of channel form for receiving at least the first region of the substrate and the thermal insulation means. The thermal insulation means may be additionally interposed between the at least one support member and one or more side edges of the substrate at the first region of the substrate.

The thermal insulation means may comprise a thin layer of microporous thermal insulation material and/or alternative thermal insulation material. Suitable alternative thermal insulation material may be selected from vermiculite, perlite, mineral fibres, calcium silicate and inorganic foam, and mixtures thereof.

The thermal insulation means may have a thickness thereof of from 1 mm to 10 mm, and preferably of from 2 mm to 4 mm, between the substrate and the at least one support member.

The first and second regions of the substrate may have substantially the same width or the second region of the substrate may be narrower than the first region of the substrate.

A single support member may underlie both the first and second regions of the substrate. In this case, the support member may be provided with one or more apertures at one or more regions thereof underlying the second region of the substrate, and/or may be provided with a coating of a material of high thermal emissivity, whereby exposure of the second region of the substrate to the effect of thermal radiation from the at least one electric heating element of the heater is maximised.

Alternatively, separate support members may be provided for the first and second regions of the substrate.

The at least one support member may comprise ceramic and/or metal.

Means may be provided to reduce or minimise thermal conduction along the substrate from the second region thereof to the first region thereof. Such means may comprise providing the substrate of small cross-sectional area, and/or providing the substrate with one or more apertures therethrough at a location intermediate the first and second regions thereof and/or providing the substrate of low thermal conductivity material.

The substrate may comprise alumina, such as of 87 to 99 percent purity, steatite, forsterite, glass-ceramic, fused silica, celsian, aluminium titanate, cordierite, zirconia, alumina-zirconia blends, reaction bonded silicon nitride, or a thin metal strip such as of stainless steel, provided with a coating of a dielectric material.

The substrate may have a thickness from about 0.25 mm to about 3 mm and preferably from about 0.5 mm to about 1 mm.

The substrate and the support member may extend outwardly from the heater at a periphery of the heater and be secured to the heater at the periphery of the heater, such as by means of a mounting bracket, which may comprise stainless steel, plated mild steel or a high temperature resistant plastics material. The mounting bracket may be arranged to bias the substrate towards the lower surface of the cooking plate. For this purpose, the mounting bracket may be of cantilevered or spring-loaded form.

The electrical connecting leads for the first and second temperature-sensitive electrical resistance elements may be of film form on the substrate and may extend to an end of the substrate located at a periphery of the heater. Such film-form electrical connecting leads may be provided with electrical terminal means, adapted for electrical connection to external electrically conducting leads leading to the external control circuit means.

The electrical connecting leads of film form may comprise substantially the same or similar material as the temperature-sensitive electrical resistance elements.

The temperature-sensitive electrical resistance elements may comprise platinum.

One or more electrically insulating or passivation layers may be provided on the upper and/or lower surface or surfaces of the substrate at least overlying the at least one first and/or the at least one second temperature-sensitive electrical resistance element or elements.

The substrate may be secured to the at least one support member by rivets, bolts or pins.

The cooking plate may comprise glass-ceramic material.

By means of the present invention, a compact, unitary and economically-manufactured temperature sensor assembly is provided. First and second film-form temperature-sensitive electrical resistance elements are provided on a single elongate substrate such that the first temperature-sensitive electrical resistance element is arranged to monitor temperature of a cooking utensil on the cooking plate, while the second temperature-sensitive electrical resistance element is arranged to monitor temperature of the cooking plate when exposed to radiation from a heating element in the heater. The first temperature-sensitive electrical resistance element is shielded by thermal insulation means from direct radiation from the heating element in the heater.

For a better understanding of the present invention and to show more clearly how it may be carried into effect, reference will now be made, by way of example, to the accompanying drawings in which.

Figure 1:
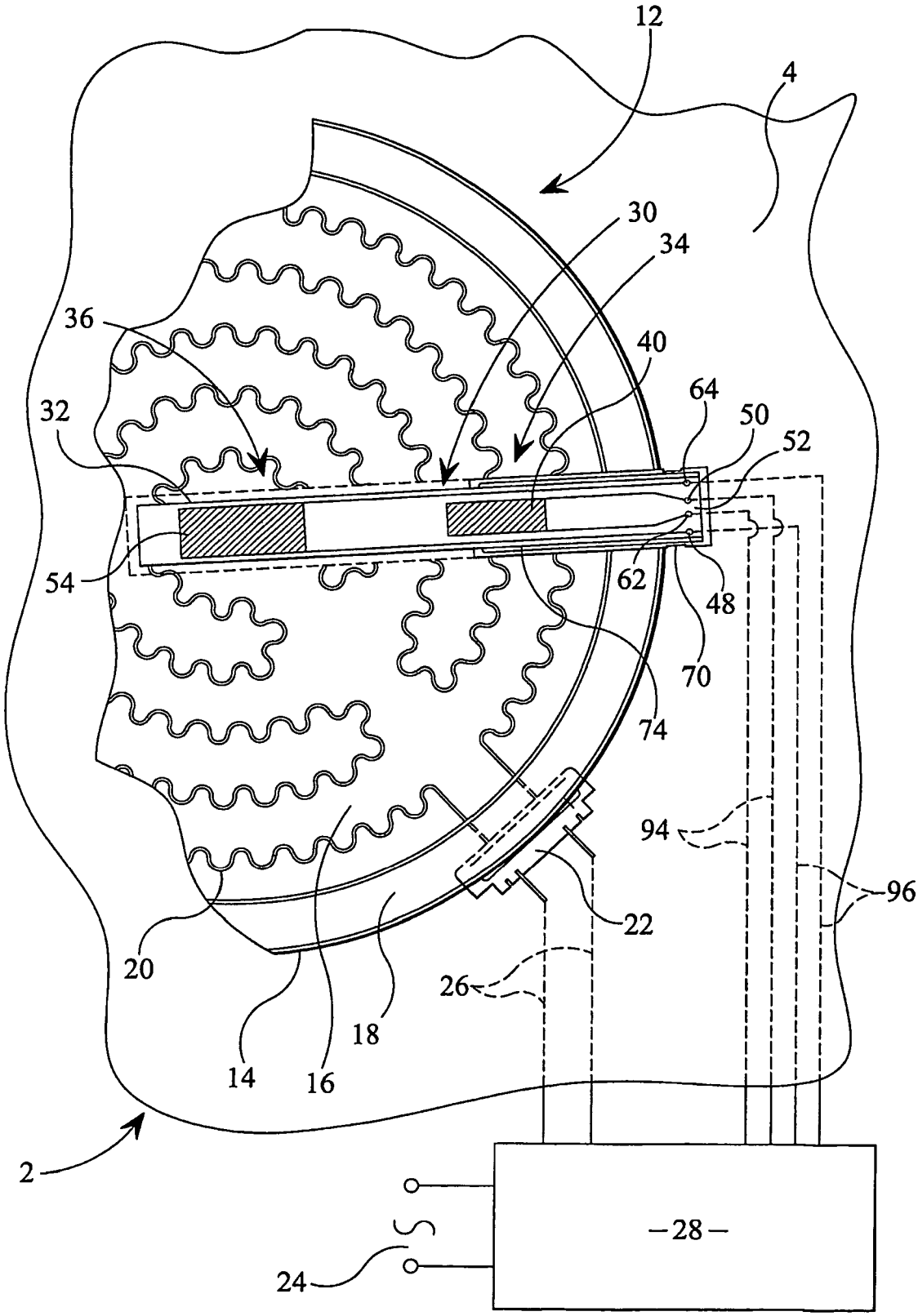
FIG. 1 is a plan view of one embodiment of an electrical heating arrangement according to the present invention.
Figure 2:
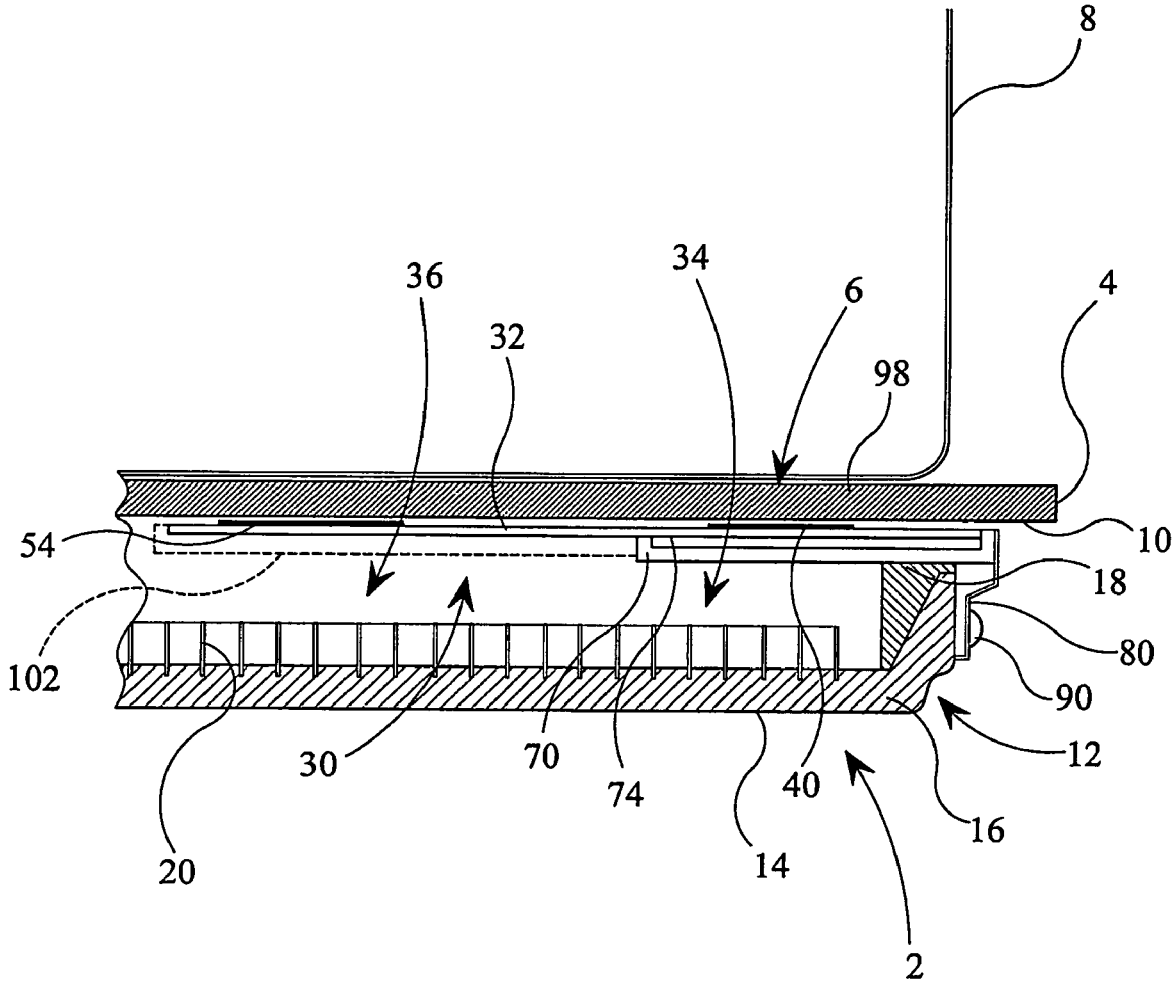
FIG. 2 is a cross-sectional view of the arrangement of FIG. 1.

Referring to FIGS. 1 and 2, an electrical heating arrangement 2 comprises a glass-ceramic cooking plate 4 of well-known form, having an upper surface 6 for receiving a cooking utensil 8, such as a pan. A lower surface 10 of the cooking plate 4 has an electric heater 12 supported in contact therewith. The electric heater 12 comprises a dish-like support 14, such as of metal, in which is provided a base layer 16 of thermal and electrical insulation material, such as microporous thermal and electrical insulation material. A peripheral wall 18 of thermal insulation material is arranged to contact the lower surface 10 of the cooking plate 4.

At least one radiant electrical resistance heating element 20 is supported relative to the base layer 16. The heating element or elements can comprise any of the well-known forms of heating element, such as wire, ribbon, foil or lamp forms, or combinations thereof. In particular, the heating element or elements 20 can be of corrugated ribbon form, supported edgewise on the base layer 16 of insulation material.

It is to be understood, however, that the present invention is not limited to a heater incorporating at least one radiant electrical resistance heating element 20. Instead of the radiant electrical resistance heating element or elements, at least one electrical induction heating element could be provided.

A terminal block 22 is provided at an edge region of the heater 12, for connecting the heating element or elements 20 to a power supply 24 by way of leads 26 and through a control means 28, which may be a microprocessor-based control arrangement.

Figure 3A:
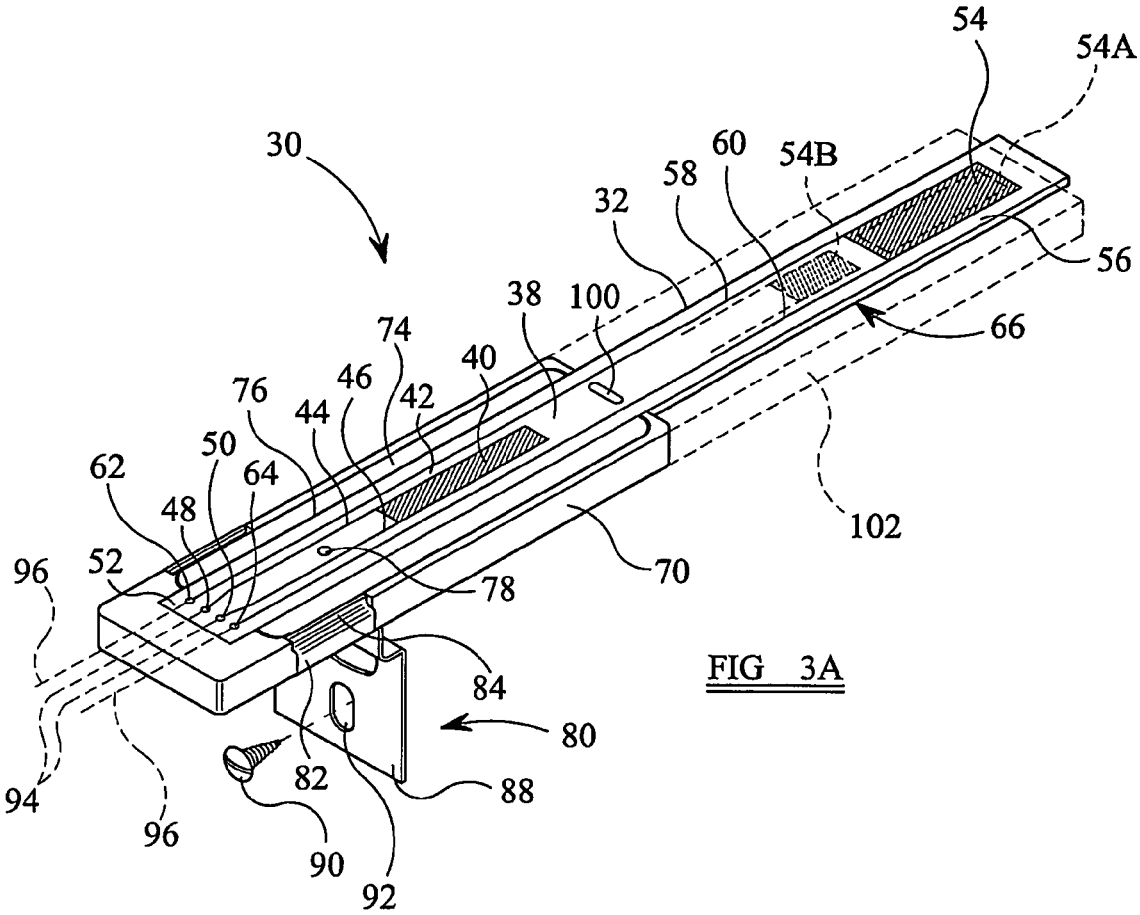
FIG. 3A is a perspective view of an embodiment of a temperature sensor assembly for use in the arrangement of FIGS. 1 and 2.
Figure 3C:
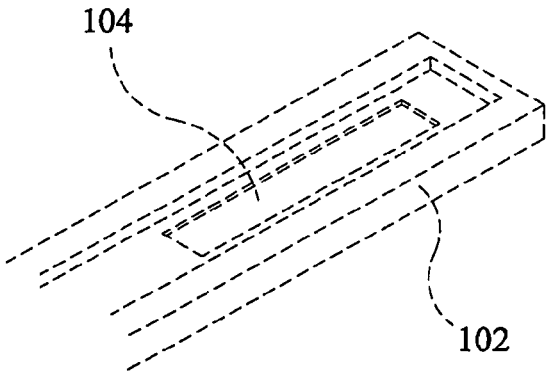
FIG. 3C is a detail of part of an alternative support member arrangement in the assembly of FIG. 3A, showing an opening in a lower face thereof.
Figure 3B:
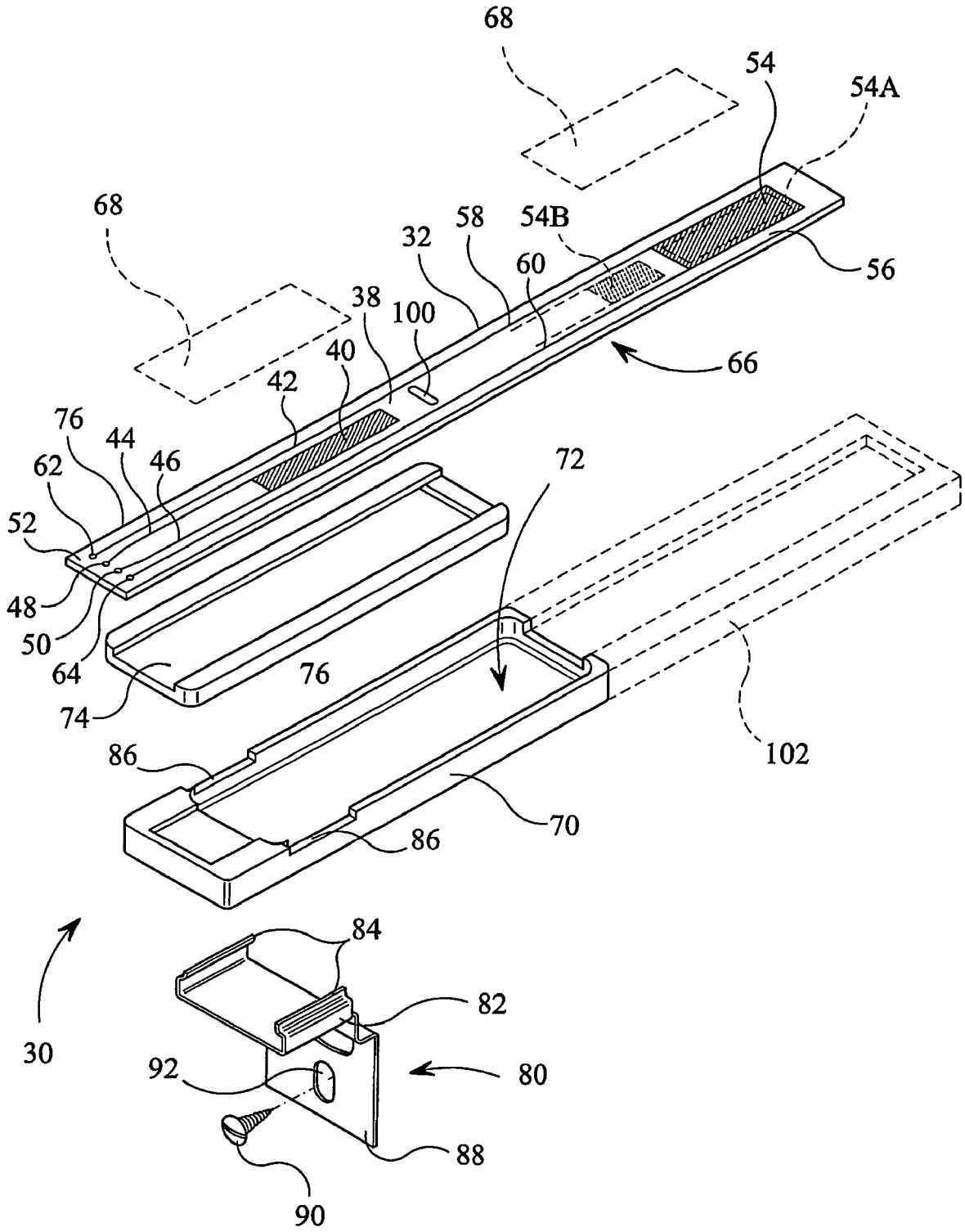
FIG. 3B is an exploded view of the temperature sensor assembly of FIG. 3A.

A temperature sensor assembly 30 is provided in the heater 12 and as shown in detail in FIGS. 3A and 3B. The temperature sensor assembly 30 comprises a thin elongate substantially planar substrate 32, which is adapted to be located in the heater 12 to extend at least partially across the heater from a peripheral region 34 of the heater at least to a central region 36 of the heater. If required, the substrate 32 could be arranged to extend substantially completely across the heater.

The substrate 32 has an upper surface 38 adapted to be located in contact with, or in close proximity to, the lower surface 10 of the cooking plate 4. Although the upper surface 38 of the substrate 32 is advantageously arranged to be located in contact with the lower surface 10 of the cooking plate 4, it may be located a small distance therefrom, for example up to about 3.5 mm therefrom.

The upper surface 38 of the substrate 32 is provided with a first temperature-sensitive electrical resistance element 40 of film form at a first region 42 of the substrate 32, which is arranged to be proximate the peripheral region 34 of the heater 12. The first temperature-sensitive electrical resistance element 40 suitably comprises platinum. If desired, more than one first temperature-sensitive electrical resistance element 40 may be provided.

Film-form electrical connecting leads 44, 46, suitably of substantially the same or similar material as the resistance element 40, are provided on the upper surface 38 of the substrate 32 and extending to terminal regions 48, 50 at an end 52 of the substrate 32.

Instead of or additional to the first temperature-sensitive electrical resistance element 40 provided on the upper surface 38 of the substrate 32, a first temperature-sensitive electrical resistance element could be provided on a lower surface 66 of the substrate 32. In this case, film-form electrical connecting leads similar to connecting leads 44 and 46 would be provided extending along the lower surface 66 of the substrate 32 from the resistance element to terminal regions at the end 52 of the substrate 32.

A second temperature-sensitive electrical resistance element 54 of film form, and suitably comprising platinum, is provided on the upper surface 38 of the substrate 32 at a second region 56 of the substrate, which is arranged to be proximate the central region 36 of the heater 12. Film-form electrical connecting leads 58, 60, suitably of substantially the same or similar material as the resistance element 54, are provided on the upper surface 38 of the substrate 32 and extending to terminal regions 62, 64 at the end 52 of the substrate 32.

Instead of or additional to the second temperature-sensitive electrical resistance element 54 provided on the upper surface 38 of the substrate 32, a second temperature-sensitive electrical resistance element 54A could be provided on a lower surface 66 of the substrate 32. In this case, film-form electrical connecting leads similar to connecting leads 58 and 60 would be provided extending along the lower surface 66 of the substrate 32 from the resistance element 54A to terminal regions at the end 52 of the substrate 32.

Two or more second temperature-sensitive electrical resistance elements 54, 54A, 54B may be provided at the second region 56 of the substrate 32, on the upper and/or lower surface or surfaces thereof, and their changes in electrical resistance with temperature arranged to be averaged.

The first and second electrical resistance elements 40, 54 are suitably arranged with a resistance value of between 50 and 1000 ohms and preferably between 100 and 500 ohms, at 0 degrees Celsius. They may be located relatively close together or quite widely separated on the substrate 32. They may be of thick film form and deposited on the substrate 32 by screen-printing.

One or more electrically insulating or passivation layers 68 may be provided on the upper 38 and/or lower 66 surfaces of the substrate, at least overlying the first 40 and/or second 54, 54A, 54B temperature-sensitive electrical resistance elements.

A support member 70, preferably of ceramic material such as steatite, cordierite or alumina, but optionally of metal, is secured to the substrate 32 such that it extends from the end 52 of the substrate 32 and underlies at least the first region 42 of the substrate 32. The support member 70 is of channel form, provided with an elongate recess 72 into which is received the first region 42 of the substrate 32.

Thermal insulation means 74 is provided in the recess 72 in the support member 70, interposed between the support member 70 and the lower surface 66 and side edges 76 of the first region 42 of the substrate 32. The thermal insulation means 74 is accordingly confined substantially to the first region 42 of the substrate 32 on the surface of which the first temperature-sensitive electrical resistance element 40 is provided.

The thermal insulation means 74 preferably comprises a thin layer of microporous thermal insulation material, suitably of a thickness between 1 and 4 mm and preferably between 2 and 3 mm. Alternatively or additionally, the thermal insulation means 74 could comprise material selected from vermiculite, perlite, mineral fibres, calcium silicate and inorganic foam material, and mixtures thereof.

The substrate 32 is suitably secured to the support member 70 by one or more pins, bolts or rivets 78.

A mounting bracket 80 is provided for the temperature sensor assembly. The mounting bracket 80 suitably comprises stainless steel or plated mild steel, but may optionally comprise a high temperature-withstanding plastics material. The mounting bracket 80 has a first portion 82 arranged with clip means 84 securely engaging recessed or rebated portions 86 of the support member 70. The mounting bracket 80 has a second portion 88 arranged to be secured to an outer rim of the dish-like support 14 of the heater 12, by means of a threaded fastener 90 passing through a hole 92 in the second portion 88 of the mounting bracket 80.

The temperature sensor assembly 30 is installed in the heater 12 such that it passes through an aperture or recess in the peripheral wall 18 of the heater and a rim of the dish-like support 14. The end 52 of the substrate 32, with the terminal regions 48, 50, 62, 64, extends outwardly from the heater on the support member 70.

The mounting bracket 80 is suitably provided of cantilevered form from a single bent sheet or strip of metal and such that the substrate 32 is spring-biased towards the lower surface 10 of the cooking plate 4. The mounting bracket 80 may be constructed to incorporate alternative spring-loading means.

The first temperature-sensitive electrical resistance element 40 is arranged to be electrically connected to the control means 28 by way of electrical leads 94 connected to the terminal regions 48, 50. The second temperature-sensitive electrical resistance element 54 is arranged to be electrically connected to the control means 28 by way of electrical leads 96 connected to the terminal regions 62, 64.

During operation of the electrical heating arrangement 2, the first region 42 of the substrate 32, with the first temperature-sensitive electrical resistance element 40 thereon, is shielded from direct thermal radiation from the heating element or elements 20 in the heater 12 by the thermal insulation means 74. A region 98 of the glass-ceramic cooking plate 4 immediately overlying the first region 42 of the substrate 32 is also shielded from the direct thermal radiation from the heating element or elements 20. The first temperature-sensitive electrical resistance element 40 is therefore able to monitor the temperature of a cooking utensil 8 located on the upper surface 6 of the cooking plate 4, heat being conducted from the cooking utensil 8 into the region 98 of the cooking plate 4. Small changes in temperature of the cooking utensil 8 are therefore able to be monitored by the first temperature-sensitive electrical resistance element 40 and the resistance element 40 may therefore be used in association with the control means 28 to provide a closed loop autocook operation of the assembly and/or to detect when an important event, such as a boil-dry situation, occurs in the cooking utensil 8, accompanied by a small change in temperature.

The second temperature-sensitive electrical resistance element 54 on the second region 56 of the substrate 32 extends from the support member 70 and is not provided with the thermal insulation means 74. It is therefore able to monitor the temperature of the cavity in the heater in which it is located and particularly the temperature of the cooking plate 4 adjacent to it and which is substantially exposed to direct thermal radiation from the heating element or elements 20. The close proximity of the second temperature-sensitive electrical resistance element 54 to the lower surface 10 of the cooking plate 4 enables the element 54 to accurately and sensitively monitor the temperature of the cooking plate 4.

Figure 4:
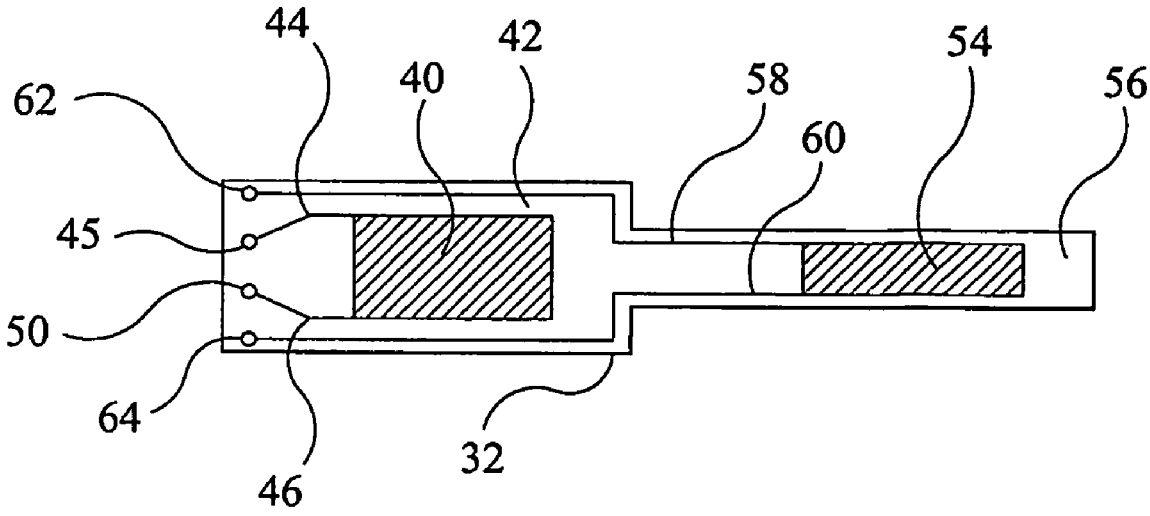
FIG. 4 is a plan view of an alternative form of elongate substrate for use in the temperature sensor assembly of FIGS. 3A, 3B and 3C.

It is advantageous to provide the second region 56 of the substrate 32 of as narrow a width as possible in order to economise on material of the substrate 32 and also to minimise shadowing thereby of the overlying region of the cooking plate 4 with respect to radiation from the heating element or elements 20. The substrate 32 may therefore be formed as shown in FIG. 4, in which the second region 56 thereof on which the second temperature-sensitive electrical resistance element 54 is provided is of narrower width than the first region 42 thereof on which the first temperature-sensitive electrical resistance element 40 is provided. Such an arrangement is particularly preferred when the first temperature-sensitive electrical resistance element 40 is relatively wide, for example between about 8 mm and about 20 mm, thereby requiring a relatively wide first region 42 of the substrate 32. However, if the first resistance element 40 is relatively narrow, for example between about 3 mm and about 8 mm, a substrate 32 of substantially constant width along its length may be satisfactorily employed.

Exposure of the second temperature-sensitive electrical resistant element 54 directly to the temperature of the surrounding cavity in the heater 12 in which it is located means that its own temperature will fluctuate during operation of the heater 12. This fluctuation may be transmitted along the substrate 32 and detected as thermal noise by the first temperature-sensitive electrical resistance element 40, which is undesirable. In order to reduce the magnitude of the heat flow, certain features can be incorporated into the design of the substrate 32.

Heat conduction is inversely proportional to the cross-section of material perpendicular to the direction of heat flow and thus the smaller the cross-sectional area of the substrate 32, the lower will be the heat flow, as given by the following equation:

$$q=TC_S \cdot A(T_H-T_C)/X_S$$

where:

q=heat flow $TC_S$=thermal conductivity of substrate

A=cross-sectional area of substrate $T_H$=temperature of second region 56 of substrate 32

$T_C$=temperature of first region 42 of substrate 32

$X_S$=length of substrate

A substrate 32 with the thinnest possible cross-section consistent with adequate mechanical properties is therefore preferred. In practice, a suitable thickness for the substrate 32 is from about 0.25 mm to about 3 mm and preferably from about 0.5 mm to about 1 mm.

Instead of or in addition to providing the substrate 32 of as thin as possible cross-section, a portion of the substrate 32 may be removed at a location between the first region 42 and the second region 56, to form an aperture 100 thereby effectively reducing the cross-sectional area of the substrate 32 at this location.

An alternative method of reducing heat flow along the substrate 32 is to reduce or minimise the thermal conductivity of the substrate 32. A preferred material for the substrate 32 is alumina of 87 to 99 percent purity, which is relatively inexpensive, is readily available, has good mechanical strength, and has high electrical resistivity and dielectric strength. Although such material has a relatively high thermal conductivity of 20 to 30 W/m·K at room temperature, its thermal conductivity decreases markedly with increasing temperature. For example, 95 percent alumina has a thermal conductivity of about 23 W/m·K at a temperature of 25 degrees Celsius and this figure gradually reduces to about 6 W/m·K at a temperature of 1000 degrees Celsius.

Other materials may be employed for the substrate 32, which have thermal conductivities of about 5 W/m·K or less. Examples of such materials are steatite, forsterite, glass-ceramics (such as supplied by Corning under the trade name Macor), fused silica, celsian, aluminium titanate, cordierite, zirconia, alumina-zirconia blends, and low density reaction-bonded silicon nitride.

A metal, such as stainless steel, provided with a suitable high temperature-withstanding dielectric coating, could be considered for the substrate 32. Although such a metal has quite high thermal conductivity (20 to 25 W/m·K), very thin sections could be adopted, thereby reducing heat flow therealong.

It may be advantageous to provide some mechanical support for the second region 56 of the substrate 32. For this purpose a support member 102 may be provided, which may be of channel form and which may form an integral extension of the support member 70 or may be separate therefrom. No thermal insulation means is provided in association with the support member 102, in contrast to the support member 70. The support member 102 preferably comprises a material of high thermal emissivity in order to ensure rapid thermal response of the second temperature-sensitive electrical resistance element 54 to changes in temperature of its surroundings. A support member 102 of thin ceramic material would be satisfactory, although a metal support member 102, such as of stainless steel, could be used if coated with a layer of high-emissivity material.

As shown in FIG. 3C, one or more apertures 104 is or are advantageously provided in a base region of the support member 102, underlying the second temperature-sensitive electrical resistance element 54, to assist rapid response of such element 54 to changes in temperature of the surroundings.

Figure 5:
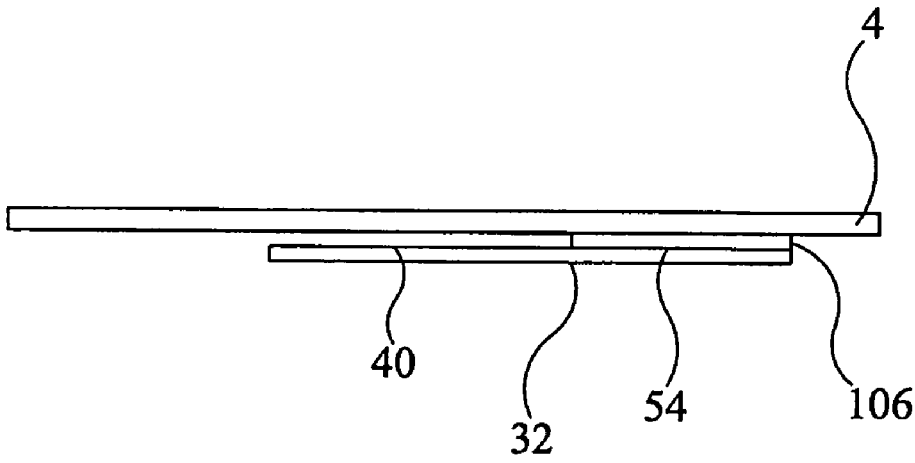
FIG. 5 is a side elevational view of an alternative form of temperature sensor assembly.

As shown in FIG. 5, it may be desirable to provide a spacer 106 or to form the passivation layer of greater thickness over the second temperature-sensitive electrical resistance element 40. While the principal reason for providing the passivation layer and/or the spacer 106 is to electrically decouple the resistance elements 40, 54 from the cooking plate 4, its presence above the substrate 32 also effectively spaces the second temperature-sensitive electrical resistance element 54 (and consequently the first temperature-sensitive electrical resistance element 40) from the cooking plate 4.

The provision of spacing means, either in the form of greater thickness or in the form of a spacer 106, can be used to adjust the response of one or both of the first and second temperature-sensitive electrical resistance elements 40, 54 and/or to improve electrical safety. The spacer 106 may have a thickness in the range from about 0.25 mm to about 3.5 mm.

The invention claimed is:

1. An electrical heating arrangement comprising: a cooking plate (4) having an upper surface (6) for receiving a cooking utensil (8), and a lower surface (10); an electric heater (12) incorporating at least one electric heating element (20), the heater being supported in contact with the lower surface of the cooking plate; and a temperature sensor assembly (30), wherein the temperature sensor assembly comprises: an elongate substantially planar substrate (32) located in the heater and extending at least partially across the heater from a peripheral region (34) at least to a central region (36) of the heater, the substrate having an upper surface (38) located in contact with, or in close proximity to, the lower surface of the cooking plate, and also a having a lower surface (66), the upper and/or lower surface or surfaces of the substrate being provided with at least one first temperature-sensitive electrical resistance element (40) of film form at a first region (42) of the substrate proximate the peripheral region of the heater, the upper and/or lower surface or surfaces of the substrate being provided with at least one second temperature-sensitive electrical resistance element (54; 54A; 54B) of film form at a second region (56) of the substrate proximate the central region of the heater, the first and second temperature-sensitive electrical resistance elements being provided with electrical connecting leads (44, 46, 58, 60) for electrical connection to external control circuit means (28) for the heater; at least one support member (70, 102) secured to the substrate and underlying at least the first region of the substrate; and thermal insulation means (74) interposed between at least the lower surface of the substrate and the at least one support member substantially only at the first region of the substrate.

2. An arrangement as claimed in claim 1, wherein the thermal insulation means (74) shields the at least one first temperature-sensitive electrical resistance element (40) and a region (98) of the cooking plate (4) overlying the at least one first temperature-sensitive electrical resistance element, from direct thermal radiation from the at least one electric heating element (20).

3. An arrangement as claimed in claim 1 wherein the at least one first temperature-sensitive electrical resistance element (40) is arranged for monitoring temperature of the cooking utensil (8) through the cooking plate (4).

4. An arrangement as claimed in claim 1, wherein the at least one second temperature-sensitive electrical resistance element (54; 54A; 54B) is arranged for monitoring temperature of the lower surface (10) of the cooking plate (4).

5. An arrangement as claimed in claim 1, wherein at least two second temperature-sensitive electrical resistance elements (54; 54A; 54B) are provided on the upper and/or lower surfaces (38, 66) of the substrate (32).

6. An arrangement as claimed in claim 1, wherein the upper surface (38) of the substrate (32) is arranged at a distance of 0 mm to about 3.5 mm from the lower surface (10) of the cooking plate (4).

7. An arrangement as claimed in claim 1, wherein the at least one support member (70, 102) is of channel form for receiving at least the first region (42) of the substrate (32) and the thermal insulation means (74).

8. An arrangement as claimed in claim 1, wherein the thermal insulation means (74) is additionally interposed between the at least one support member (70, 102) and one or more side edges of the substrate (32) at the first region (42) of the substrate.

9. An arrangement as claimed in claim 1, wherein the thermal insulation means (74) has a thickness of from 1 mm to 10 mm between the substrate (32) and the at least one support member (70, 102).

10. An arrangement as claimed in claim 9, wherein the thermal insulation means (74) has a thickness of from 2 mm to 4 mm.

11. An arrangement as claimed in claim 1, wherein the first and second regions (42, 56) of the substrate (32) have substantially the same width.

12. An arrangement as claimed in claim 1, wherein the second region (56) of the substrate (32) is narrower than the first region (42) of the substrate.

13. An arrangement as claimed in claim 1, wherein a single support member (70, 102) underlies both the first and second regions (42, 56) of the substrate (32).

14. An arrangement as claimed in claim 13, wherein the support member (70, 102) is provided with one or more apertures (104) at one or more regions thereof underlying the second region (56) of the substrate (32), whereby exposure of the second region of the substrate to the effect of thermal radiation from the at least one electric heating element of the heater is maximised.

15. An arrangement as claimed in claim 13, wherein the support member (70, 102) is provided with a coating of a material of high thermal emissivity, whereby exposure of the second region of the substrate to the effect of thermal radiation from the at least one electric heating element of the heater is maximised.

16. An arrangement as claimed in claim 1, wherein separate support members (70, 102) are provided for the first and second regions (42, 56) of the substrate (32).

17. An arrangement as claimed in claim 1, wherein thermal conduction reduction means (100) is provided to reduce or minimise thermal conduction along the substrate (32) from the second region (56) thereof to the first region (42) thereof.

18. An arrangement as claimed in claim 17, wherein the thermal conduction reduction means comprises providing the substrate with one or more apertures (104) therethrough at a location intermediate the first and second regions (42, 56) thereof.

19. An arrangement as claimed in claim 17, wherein the thermal conduction reduction means comprises providing the substrate of low thermal conductivity material.

20. An arrangement as claimed in claim 1, wherein the substrate (32) has a thickness from about 0.25 mm to about 3 mm.

21. An arrangement as claimed in claim 20, wherein the substrate (32) has a thickness from about 0.5 mm to about 1 mm.

22. An arrangement as claimed in claim 1, wherein the substrate (32) and the support member (70, 102) extend outwardly from the heater (12) at a periphery of the heater and are secured to the heater at the periphery of the heater.

23. An arrangement as claimed in claim 1, wherein the electrical connecting leads (44, 46, 58, 60) for the first and second temperature-sensitive electrical resistance elements (40; 54, 54A, 54B) are of film form on the substrate (32) and extend to an end of the substrate located at a periphery of the heater (12).

24. An arrangement as claimed in claim 23, wherein the film-form electrical connecting leads (44, 46, 58, 60) are provided with electrical terminal means (48, 50, 62, 64), adapted for electrical connection to external electrically conducting leads (94, 96) leading to the external control circuit means (28).

25. An arrangement as claimed in claim 1, wherein one or more electrically insulating or passivation layers is or are provided on the upper and/or lower surface or surfaces (38, 66) of the substrate (32) at least overlying the at least one first and/or the at least one second temperature-sensitive electrical resistance element or elements 40; 54; 54A, 54B).

* * * * *